US005475284A

United States Patent [19]

Lester et al.

[11] Patent Number: 5,475,284

[45] Date of Patent: Dec. 12, 1995

[54] BALLAST CONTAINING CIRCUIT FOR MEASURING INCREASE IN DC VOLTAGE COMPONENT

[75] Inventors: James N. Lester; William J. Roche, Merrimac, both of Mass.

[73] Assignee: Osram Sylvania Inc., Danvers, Mass.

[21] Appl. No.: 237,465

[22] Filed: May 3, 1994

[51] Int. Cl.[6] ..... H05B 37/02

[52] U.S. Cl. ..... 315/209 R; 315/224; 315/225; 315/307

[58] Field of Search ..... 315/209 R, 224, 315/225, 307, DIG. 7, DIG. 4, DIG. 5, 127

[56] References Cited

U.S. PATENT DOCUMENTS 4,503,363 3/1985 Nilssen ..... 315/225
4,554,487 11/1985 Nilssen ..... 315/224
5,075,599 12/1991 Overgoor et al. ..... 315/224
5,138,235 8/1992 Sun et al. ..... 315/209 R
5,148,359 9/1992 Nguyen ..... 363/48
5,262,699 11/1993 Sun et al. ..... 315/209 R
5,293,099 3/1994 Bobel ..... 315/225

*Primary Examiner*—Ali Neyzari
*Attorney, Agent, or Firm*—Carlo S. Bessone

[57] ABSTRACT

A ballast includes an inverter for providing an AC voltage to a discharge lamp. As the lamp approaches end-of-life a DC voltage component develops across the lamp. The ballast includes circuitry for monitoring the condition of each of the cathodes by measuring this DC voltage component. After a predetermined increase in this DC voltage component, the inverter is disabled in order to prevent excessive heating of the cathodes.

12 Claims, 4 Drawing Sheets

BALLAST CONTAINING CIRCUIT FOR MEASURING INCREASE IN DC VOLTAGE COMPONENT

FIELD OF THE INVENTION

This invention relates to arc discharge lamps, particularly compact fluorescent lamps, and especially to electronic ballasts containing circuitry for protecting the lamp from overheating at end-of-life and for protecting the ballast from component failure.

BACKGROUND OF THE INVENTION

Low-pressure arc discharge lamps, such as fluorescent lamps, are well known in the art and typically include a pair of cathodes made of a coil of tungsten wire upon which is deposited a coating of an electron-emissive material consisting of alkaline metal oxides (i.e., BaO, CaO, SrO) to lower the work function of the cathode and thus improve lamp efficiency. With electron-emissive material disposed on the cathode filament, the cathode fall voltage is typically about 10 to 15 volts. However, at the end of the useful life of the lamp when the electron-emissive material on one of the cathode filaments becomes depleted, the cathode fall voltage quickly increases by 100 volts or more. If the external circuitry fails to limit the power delivered to the lamp, the lamp may continue to operate with additional power being deposited at the lamp cathode region. By way of example, a lamp which normally operates at 0.1 amp would consume 1 to 2 watts at each cathode during normal operation. At end-of-life, the depleted cathode may consume as much as 20 watts due to the increase in cathode fall voltage. This extra power can lead to excessive local heating of the lamp and fixture.

Small diameter (e.g., T2 or ¼ inch) fluorescent lamps generally have very high ignition voltage requirements necessitating the use of ballasts with open circuit output voltages which may exceed 1000 volts. Such voltage levels are enough to sustain a conducting lamp with an arc drop of 50 to 150 volts with a depleted cathode and an end-of-life cathode fall voltage of 200 volts. In this example, the lamp would run at nearly rated current because the excess voltage would be mostly dropped across the output impedance of the ballast. Since the cathodes in these small diameter T2 lamps are placed much closer to the internal tube wall than in larger diameter lamps, less cathode power is needed to overheat the glass in the area of the cathode. In such T2 diameter lamps, it would be desirable to limit the increase in cathode power to 6 watts in order to avoid excessive local heating.

For a 6 watt increase in cathode power, the corresponding RMS lamp voltage increase is only about 52 volts. Normal lamp voltage varies with lamp length, production variation, cathode heating, ambient temperature, and fixture effects and can easily vary by 50 volts or more. For example, the lamp voltage of a typical 13 watt T2 diameter lamp during normal operation may vary from 115 volts to 165 volts.

Various attempts have been made to provide overvoltage or over-current protection in inverter-type ballasts in order to prevent circuit damage due to excessive load power. For example, U.S. Pat. No. 5,262,699, which issued to Sun et al on Nov. 16, 1993, describes an inverter-type ballast having means for detecting a relatively large increase in current resulting from a resonant mode or open circuit (i.e. no load) condition. The inverter is disabled whenever the lamp is removed or if the lamp fails to ignite. Depletion of emissive material on one or more of the lamp electrodes, which prevents the lamp from igniting, will cause such an open circuit condition.

U.S. Pat. No. 4,503,363, which issued to Nilssen on Mar. 5, 1985, describes an inverter-type ballast having a subassembly which senses the voltage across the output of the ballast. When an open circuit condition is detected at the input of the subassembly, resulting from the removal of a lamp from one of its sockets or the failure of a lamp to ignite, the inverter is disabled.

While the disabling circuits of U.S. Pat. Nos. 5,262,699 and 4,503,363 may be effective at disabling the inverter upon detection of a relatively large increase in current or voltage, these circuits are ineffective at responding to relatively small increases in cathode fall power.

"Quicktronic" inverter ballasts manufactured by OSRAM GmbH for operating "Dulux DE" compact fluorescent lamps monitor an increase in ballast input power by sensing supply voltage which is boosted with RF feedback from the lamp. Effectively, lamp voltage is sensed since lamp current is somewhat constant in the ballast over the sense range i.e., voltage=power/current. An increase in input power of about 6 to 10 watts with a ±2 watt tolerance is required to disable the inverter. Due to the drawbacks of voltage sensing as discussed above, this approach is best suited for sensing very large voltage increases such as a lamp no start or open circuit load condition. Moreover, this approach requires tight control of circuit component tolerances which adds to cost and reduces load flexibility. Finally, this approach is not easily adapted to a multiple lamp configuration because it is difficult to sense lamps independently.

SUMMARY OF THE INVENTION

It is, therefore, an object of the present invention to obviate the disadvantages of the prior art.

It is another object of the invention to provide an inverter disabling circuit which provides lamp and circuit component protection following a small increase in lamp voltage resulting from a relatively small increase in cathode power.

It is still another object of the invention to provide an inverter disabling circuit which does not require tight control of circuit component tolerances and which is readily adaptable to multiple lamp configurations.

These objects are accomplished in one aspect of the invention by the provision of a ballast for a discharge lamp having a pair of cathodes wherein the discharge lamp is characterized by a lamp voltage waveform having a DC voltage component when the lamp approaches end-of-life upon depletion of emissive material on one of the cathodes. The ballast comprises an inverter for providing an AC voltage at a pair of output terminals, means for coupling the discharge lamp to the output terminals of the inverter, and means for monitoring the condition of each of the cathodes by measuring the DC lamp voltage component. The inverter is disabled after a predetermined increase in the DC lamp voltage component whereby excessive heating of either cathode is prevented.

In accordance with further teachings of the present invention, the predetermined increase in the DC voltage component is within the range of from about 3 to 52 volts. Preferably, the inverter is disabled following an increase in cathode power of from about 0.3 to 6.0 watts. In a preferred embodiment, the disabling means includes a full wave bridge rectifier having an input coupled to the means for monitoring the DC voltage component.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
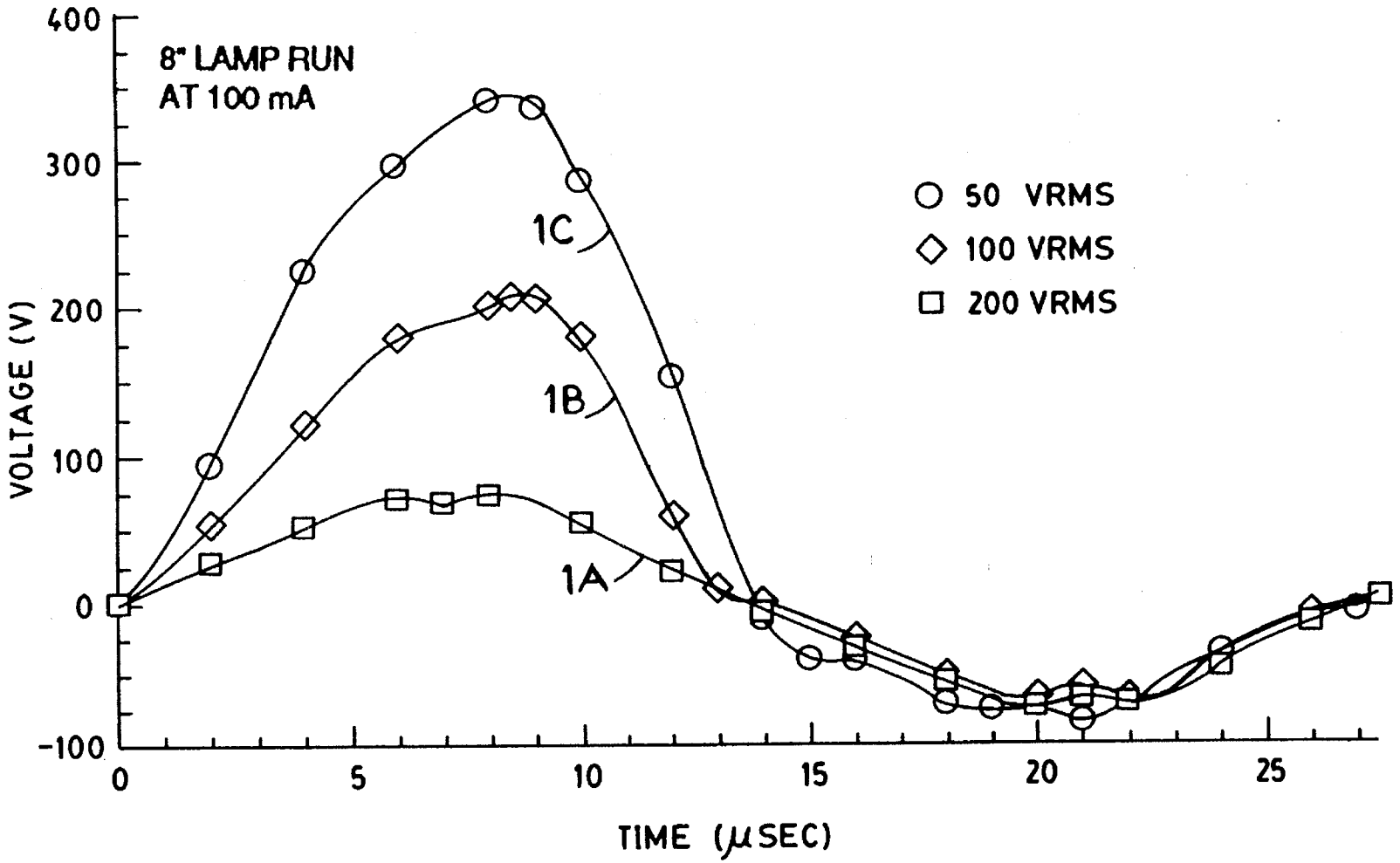
FIG. 1 is a plot of lamp voltage as a function of time showing the introduction of a DC component to the lamp voltage waveform as one lamp cathode wears out.

FIG. 1 is a plot of lamp voltage as a function of time for one cycle showing the introduction of a DC component to the lamp voltage waveform as one lamp cathode wears out. In a normally operating arc discharge lamp, as indicated by the waveform 1A having an RMS lamp voltage of 50 volts, the cathode fall voltages of each cathode are equal. Since the current waveform driving the lamp, in this example, is symmetrical around the zero axis, the lamp voltage will contain an AC component and no DC component. As the lamp approaches end-of-life when the electron-emissive material on one of the electrode filaments becomes depleted, the lamp will appear to partially rectify and a DC component will be added to the total lamp voltage as indicated by waveforms 1B and 1C. Due to an increase in cathode fall voltage, the power consumed by the depleted cathode increases and may lead to excessive local heating of the lamp and fixture if not limited.

It should be noted that a depletion of emissive material on the opposite cathode would also be indicated by the addition of a DC component (of opposite polarity) but with a negative increase in the peak voltage appearing in the second half of the lamp voltage waveform.

In T2 (i.e., ¼ inch) diameter lamps, it would be desirable to limit the increase in cathode power to a maximum of 6 watts in order to avoid any excessive local heating. For a larger diameter lamp, the allowable increase in cathode power may be adjusted accordingly. In the present example, a 6 watt increase in cathode fall power corresponds to a change in overall DC lamp voltage from zero volts to about 52 volts. The present invention monitors the condition of each lamp electrode by sensing the DC component in the lamp's voltage waveform independent of the AC component.

Figure 2:
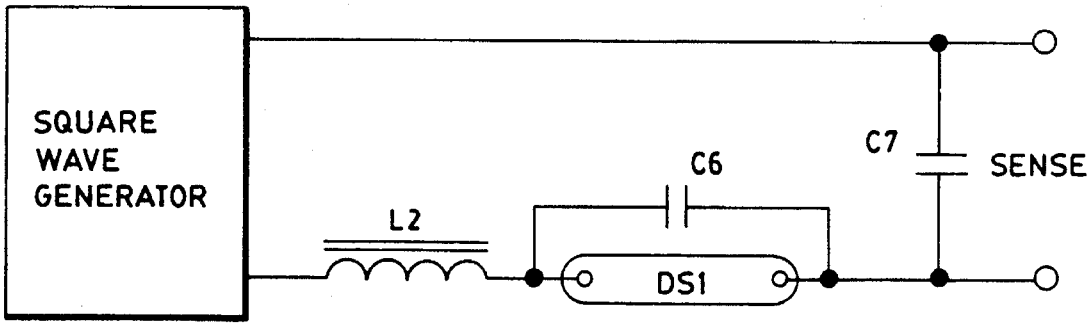
FIG. 2 is a simplified diagram of one method of series sensing both AC and DC voltages of an arc discharge lamp.

With particular attention to FIG. 2, there is illustrated a simplified diagram for series sensing both DC voltage and AC current of an arc discharge lamp according to one embodiment of the invention. In FIG. 2, a squarewave generator provides an AC waveform having no DC component. While a squarewave generator is shown, it is understood that it may be replaced by a sinewave or other waveform generator. The output of the squarewave generator in FIG. 2 is connected to a series combination of an inductor L2, an arc discharge lamp DS1 and a sensing capacitor C7. A starting capacitor C6 is connected across lamp DS1. Inductor L2 acts as an AC impedance to limit current through lamp DS1.

At the end of the useful life of the lamp when the electron-emissive material on one of the cathode filaments becomes depleted, the lamp will partially rectify and a DC voltage component will develop across capacitor C7. The voltage developed across capacitor C7 will be equal in magnitude and opposite in polarity to the DC voltage component across lamp DS1. The value of capacitor C7 is not critical to the magnitude of the sensed DC voltage.

Preferably, starting capacitor C6 is two orders of magnitude smaller than capacitor C7 and is used with inductor L2 in a resonance circuit to ignite lamp DS1. If lamp DS1 is off, the squarewave generator sees a series LC circuit. If the squarewave's fundamental or a harmonic frequency matches the L2C6 series resonance, very high resonance currents will flow.

The high current through capacitor C6 develops a high voltage across capacitor C6 which is used to ignite the lamp. This high resonant current also passes through capacitor C7 and develops a high AC voltage thereacross. In the present embodiment, this AC voltage is used by the sense circuit to be described below to detect that the ballast is in a high current resonant starting mode. The inverter is disabled if the lamp does not ignite within an acceptable amount of time (e.g., 2–4 seconds).

The value of sense capacitor C7 in FIG. 2 can be varied to control the magnitude of the sensed AC voltage independent of any DC component discussed earlier. Sense capacitor C7 has independent AC and DC voltage components which are used by shutdown circuitry 20. The sensed DC voltage component is used to trigger shutdown circuitry 20 and thereby disable the ballast in response to detection of a rectifying lamp as the lamp approaches end-of-life. Alternatively, the shutdown circuitry is triggered by the sensed AC voltage component if the lamp does not light or if the lamp is removed from the circuit or, in other words, an open circuit condition or high AC lamp voltage is detected.

Capacitor C6 is not necessary if the output voltage of the squarewave generator is high enough to light the lamp or if some other starting means is used. In this case, only the DC voltage of capacitor C7 needs to be monitored.

Figure 3:
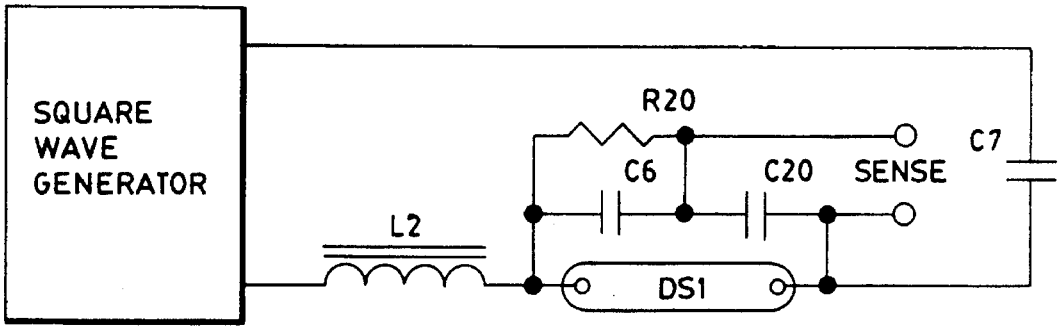
FIG. 3 is a simplified diagram of another method of parallel sensing both AC and DC voltages of an arc discharge lamp.

FIG. 3 illustrates a simplified diagram for parallel sensing both AC and DC voltages of an arc discharge lamp according to another embodiment of the invention. In FIG. 3, the output of the squarewave generator is connected to a series combination of an inductor L2, an arc discharge lamp DS1 and a capacitor C7. A series combination of capacitors C6 and C20 is connected across arc discharge lamp DS1 to provide resonant starting. A resistor R20 is connected in parallel with capacitor C6.

Capacitors C6 and C20 form an AC voltage divider which provides an AC voltage across capacitor C20 that is proportional to the AC lamp voltage. Capacitor C6 is generally smaller than capacitor C20 by an order of magnitude so resonant calculations must include the effect of capacitor C20.

Simple inverter-type circuits employing, for example, a two transistor squarewave inverter, often generate an undesired DC output voltage component. In the approach illustrated in FIG. 2 this error voltage develops across capacitor C7. However, if the transistors of the inverter are well matched, this error voltage will be relatively small. In the approach illustrated in FIG. 3, any error voltage will develop across capacitor C7 and will not affect the sense output. Capacitor C7 in FIG. 3 is optional and can be used to block any DC voltage which may be present at the output of the squarewave generator. If desired, capacitor C7 may be eliminated.

At the end of the useful life of the lamp when the electron-emissive material on one of the cathode filaments becomes depleted, the lamp will partially rectify and a DC voltage component will develop across capacitor C20 in FIG. 3. The voltage developed across capacitor C20 will be equal in magnitude and polarity to the DC voltage component across lamp DS1. The value of capacitor C20 is not critical to the magnitude of the sensed DC voltage.

Figure 4:
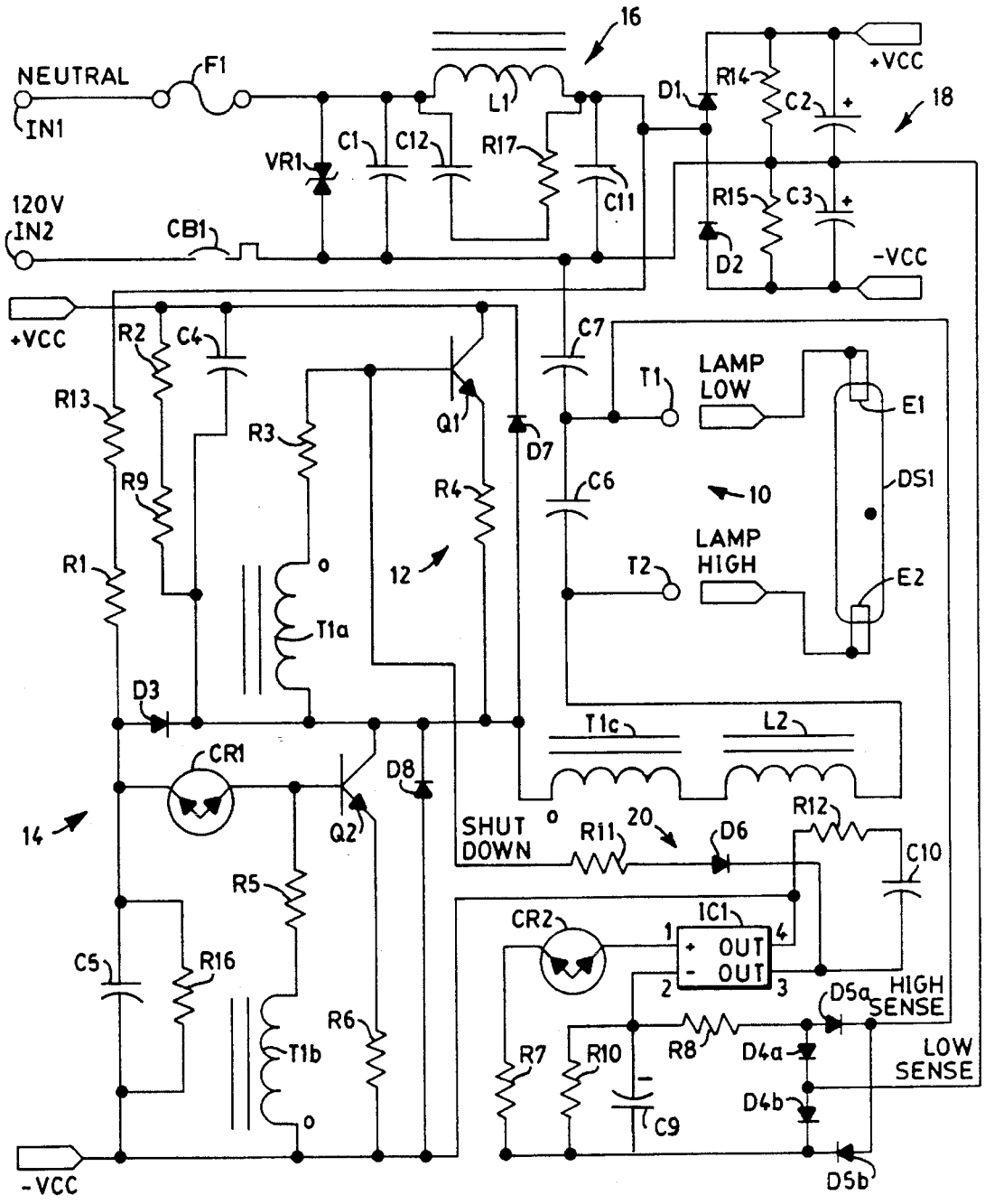
FIG. 4 is a schematic diagram of one embodiment of a ballast for a single arc discharge lamp in accordance with the present invention.

FIG. 4 represents a schematic diagram of a preferred embodiment of a ballast for a discharge lamp DS1. Lamp DS1 is an arc discharge lamp such as a low-pressure fluorescent lamp or a high-pressure high intensity discharge lamp having a pair of opposing filamentary cathodes E1, E2. Each of the filamentary cathodes is coated during manufacturing with a quantity of emissive material. Lamp DS1, which forms part of a load circuit 10, is ignited and fed via an oscillator 12 which operates as a DC/AC converter. Oscillator 12 receives filtered DC power from a DC power supply 18 which is coupled to a source of AC power. Conduction of oscillator 12 is initiated by a starting circuit 14. In order to prevent excessive heating of the cathodes, circuit 20 temporarily disables the oscillator upon detection of a lamp which is approaching the end of it's useful life and is beginning to rectify. In a preferred embodiment, circuit 20 will also temporarily disable the oscillator upon detection, for example, of a completely failed lamp (i.e., no current flow therethrough) and a removed lamp.

A pair of input terminals IN1, IN2 are connected to an AC power supply such as 108 to 132 volts, 60 Hz. A fuse F1, a circuit breaker CB1 and a varistor RV1 are connected in series across input terminals IN1, IN2 in order to provide over current, thermal and line voltage transient protection, respectively.

A network 16 consisting of an inductor L1, a pair of capacitors C11 and C12, and a resistor R17 is connected in series with input terminal IN1 and the input of a DC power supply 18. Network 16 forms a third order, damped low-pass filter that waveshapes the AC input current so as to increase the power factor and lower the total harmonic distortion the input of the DC power supply presents to the AC power supply. Details of this network can be found in U.S. Pat. No. 5,148,359 which issued to Ngyuyen.

DC power supply 18 consists of a voltage doubler arrangement which includes a pair of diodes D1 and D2 and a pair of capacitors C2 and C3. Capacitors C2 and C3 are shunted by resistors R14 and R15, respectively. Resistors R14 and R15 safely discharge capacitors C2 and C3 when power is off and also allow for the quick resetting of the shutdown circuit by discharging the latching operation in about 2.5 seconds. A pair of capacitors C1 and C11 together with inductor L1 provide EMI noise filtering.

Oscillator 12, which includes (as primary operating components) a pair of series-coupled semiconductor switches, such as bipolar transistors Q1, Q2 or MOSFETS (not shown), is coupled in parallel with output terminals +VCC and −VCC of DC power supply 18. The collector of transistor Q1 is connected to terminal +VCC. The emitter is connected to one end of a resistor R4. The other end of resistor R4 is connected to the collector of transistor Q2. The emitter of transistor Q2 is coupled to terminal −VCC through a resistor R6.

Base drive and switching control for transistors Q1 and Q2 are provided by secondary windings T1*a* and T1*b* of a saturable transformer and base resistors R3 and R5, respectively. A pair of flyback diodes D7 and D8 direct energy stored in inductor L2 back into the power supply capacitors C2 and C3 when both transistors Q1 and Q2 are not conducting.

Oscillator starting circuit 14 includes a series arrangement of resistors R1, R13 and R16 and a capacitor C5. The junction point between resistor R1 and capacitor C5 is connected to a bi-directional threshold element CR1 (i.e., a diac). One end of threshold element CR1 is coupled to the base or input terminal of transistor Q2.

During normal lamp operation, oscillator starting circuit 14 is rendered inoperable due to a diode rectifier D3 by holding the voltage across starting capacitor C5 at a level which is lower than the threshold voltage of threshold element CR1.

A pair of resistors R2 and R9 and a capacitor C4 form a snubber network to reduce transistors switching losses and to reduce EMI noise conducted back into the power line.

Load circuit 10 comprises a parallel combination of a capacitor C6 and lamp DS1 in series with primary winding T1*c*, an inductor L2 and a capacitor C7. Typically, the transistor switching frequency is from about 20 Khz to 60 Khz. The terminals T1, T2 of discharge lamp DS1 may be coupled to capacitor C6 by means of suitable sockets in order to facilitate lamp replacement. Although FIG. 4 illustrates an instant-start discharge lamp wherein the lead-in wires from each cathode are shorted together and coupled to respective terminals, other coupling arrangements are possible.

In the embodiment illustrated in FIG. 4, circuit 20 includes a full wave bridge rectifier network consisting of diodes D4*a*, D4*b*, D5*a* and D5*b*. This rectifier network permits detection of a DC voltage of either polarity, the polarity of which depends upon the cathode that becomes depleted of emissive material. A series combination of a resistor R8 and a capacitor C9 is connected across diodes D4*a* and D4*b* and provides a low pass filter with a time constant of, for example, about 0.5 second. Resistor R8 and capacitor C9 filters out lamp voltage transients which occur normally, for example, during starting when very high resonant currents are passing through capacitor C7. A resistor R10 shunting capacitor C9 discharges capacitor C9 when the sensed voltages are low allowing the shutdown circuit to reset, for example, after a start. Resistors R8 and R10 also provide for voltage division to set the trip level of the sensed DC voltage. Moreover, these resistors divide the AC sensed voltage which can be further independently adjusted by changing the value of capacitor C7.

Circuit 20 further includes an optical isolator IC1 having an input terminal (pin 1) connected to a series combination of a bi-directional threshold element CR2 and a resistor R7. The other input terminal (pin 2) of optical isolator IC1 is connected to the positive terminal of capacitor C9. One of the output terminals (pin 4) of optical isolator IC1 is connected to output terminal −VCC of DC power supply 18. The other output terminal (pin 3) is connected to one end of a diode D6. The other end of diode D6 is coupled through a resistor R11 to the base or input terminal of transistor Q1. A series combination of a resistor R12 and a capacitor C10 is connected to the output terminals of optical isolator IC1.

The current waveshape through lamp DS1 is approximately a sinewave and only varies ±4% over the acceptable rectifying lamp voltage range. Assuming a constant sinewave of lamp current and a sinewave of lamp voltage, the following shutdown relations can be developed:

$$P_{cath}=|\pi I_{lamp}*V_{dc}/(2*SQR(2))|\ V_{trip}=((R8+R10)*V_{CR2}/R10-I_{C7}/(\pi*F*C7*SQR(2)\pm V_{tcc}*F*\Delta t_{si}+1)$$

where:

$P_{cath}$=Rectifying cathode fall field power increase in watts. $\pi$=3.14159

$I_{lamp}$=RMS current through the lamp in amperes.

$V_{dc}$=The rectifying cathode DC voltage in volts.

SQR=The square root of ( . . . )

$V_{trip}$=The DC voltage where the shutdown circuit will activate in volts. A window is defined by using the minimum and maximum parameter values. If $V_{trip}<0$, then $V_{trip}=0$. When $V_{dc}$=or $<V_{trip}$, the ballast shuts down.

R8 and R10=Circuit voltage divider resistors in ohms.

$V_{CR2}$=The firing voltage of solid state switch CR2 in volts.

$I_{C7}$=Resonating current through capacitor C7 in amperes. Approximately equals the lamp current when the lamp is on.

F=Ballast oscillating frequency in HZ.

C7=Circuit sensing capacitor in Farads.

$V_{tcc}$=Supply voltage from $-V_{cc}$ to $+V_{cc}$ in volts.

$\Delta t_{si}$=The difference between the storage times in seconds of transistors Q1 and Q2.

It should be noted that the power increase in the dying cathode is directly proportional to the magnitude of the measured DC voltage across the lamp. Since either polarities of DC voltages is monitored by the sensing and disabling circuit due, in part, by the full wave bridge rectifier D4*a*, D4*b*, D5*a* and D5*b*, failure of either cathode will cause the oscillator to be disabled.

The activation voltage of circuit 20 is directly proportional to several parameters. The tolerances of these parameters define a sensing window for a family of ballasts that monitor the failure of either cathode or a high resonant current starting mode. It is desirable to use transistors that are closely matched or operate at a lower frequency to minimize the $\Delta t_{si}$ effect of transistor differences. Base drive and collector loading must also be matched or $\Delta t_{si}$ will be increased. Differences in transistor heating can cause $\Delta t_{si}$ to increase. For example, external transistor case heating can cause $\Delta t_{si}$ to increase up to 1 volt per °C. difference between the transistors. It is desirable for the transistors to be in physical contact with one another to minimize temperature differences.

In the example ballast illustrated in FIG. 4, the oscillating frequency is about 50 KHZ and the unselected transistor mismatch is 300 nanoseconds maximum. This results in a sensed mismatch error voltage of under ±5 volts DC which corresponds to a cathode power sensing error of ±0.5 watt. The other parameters are selected to provide a trip window range of 13.7 to 35.9 volts which yields a 1.5 to 3.8 watts possible cathode increase at 100 mA of lamp current. The maximum acceptable window, noted earlier for the T2 diameter lamp, is within the range of from about 3 to 52 volts which yields a 0.3 to 6.0 watt possible rejectable cathode increase range at 100 mA of lamp current.

It should also be noted that the activation voltage of circuit 20 is proportional to the current through capacitor C7. This current is approximately equal to the lamp's current when the lamp is on and can be considered a constant. While the lamp is starting or out of the circuit, this current will equal the very large resonant starting current through capacitor C6. This causes the lower side of the trip window to move towards 0 volts as capacitor C9 charges and the ballast will shut down when $V_{trip}=0$ after a delay if the lamp does not start. Setting $V_{trip}=0$, allows for the calculation of $I_{C7}$ which is independent of $V_{dc}$. With the values used in the embodiment, the nominal shut down resonating current is 210 mA or about twice the rated lamp current.

The operation of the ballast will now be discussed in more detail. When terminals IN1 and IN2 are connected to a suitable AC power source, DC power source 18 rectifies and filters the AC signal and develops a DC voltage across capacitors C2 and C3. Simultaneously, starting capacitor C5 in oscillator starting circuit 14 begins to charge through resistors R1 and R13 to a voltage which is substantially equal to the threshold voltage of threshold element CR1. Upon reaching the threshold voltage (e.g., 32 volts), the threshold element breaks down and supplies a pulse to the input or base terminal of transistor Q2. As a result, current from the DC supply flows through resistor R6, the collector-emitter junction of transistor Q2, primary winding T1*c*, inductor L2 and capacitors C6 and C7. Since the lamp is essentially an open circuit during starting, no current flows through the lamp at this time. Current flowing through primary winding T1*c* causes saturation of the transformer's core which forces the inductance of the transformer to drop to zero. A resulting collapse in the magnetic field in the transformer causes a reverse in polarity on secondary windings T1*a* and T1*b*. As a result, transistor Q2 is turned off and transistor Q1 is turned on. This process is repeated causing a high voltage to be developed across capacitor C6 (and lamp DS1) as a result of a series resonant circuit formed by capacitors C6, C7 and inductor L2. The high voltage developed across capacitor C6 is sufficient to ignite lamp DS1.

At the end of the useful life of the lamp when the electron-emissive material on one of the cathode filaments becomes depleted, the lamp will partially rectify and a DC voltage component will develop across capacitor C7 in FIG. 4. The voltage developed across capacitor C7 will be equal in magnitude and opposite in polarity to the DC voltage component across lamp DS1. The value of capacitor C7 is not critical to the magnitude of the sensed DC voltage.

The voltage developed across capacitor C7 is rectified by diodes D4*a*, D4*b*, D5*a* and D5*b* and filtered by capacitor C9. Resistors R8 and R10 provide for voltage division to set the trip level of the DC voltage measured across capacitor C7.

Resistors R8 and R10 also divide the AC sensed voltage which can be further independently adjusted by changing the value of capacitor C7. By properly adjusting resistors R8, R10 and capacitor C7, the shut down circuit 20 can be adapted to also disable the oscillator in the event the lamp does not light or if the lamp is removed from the circuit.

When the voltage across capacitor C9 reaches the threshold voltage of switch element CR2, optical isolator IC1 is triggered causing shunting of the output terminals (pins 3 and 4) of IC1 and coupling of the base of transistor Q1 to –VCC. Because of the limited voltage available at the base of transistor Q1, the base drive current will be insufficient to turn on transistor Q1, causing an interruption in operation of the oscillator. With the ballast shut down, no signal is supplied to capacitor C9 which begins to discharge through resistor R10. The output of IC1 (at pins 3 and 4) remains shunted maintaining transistor Q1 biased off and the ballast in a shutdown state. The output of IC1 contains a latching solid state switch (a triac) which receives latching current from +VCC through resistors R2 and R9 and from terminal IN1 through resistors R1 and R13.

After power to the ballast is disconnected, the voltage across capacitors C2 and C3 begin to discharge through discharge resistors R14 and R15. The circuit is reset and conduction of transistors Q1 and Q2 is restarted by reconnecting power to the ballast after allowing the voltage across capacitor C9 to drop sufficiently that the holding current level of IC1's output triac (pins 3 and 4) is not maintained. It is possible to modify circuit 20 for example, with a non-latching optical isolator, so that it would not be necessary to disconnect power to the ballast in order to reset the shut down circuit.

If switch CR1 fails to turn on during starting, the inverter will not oscillate. To disable turn on of switch CR1, a resistor R16 is preferably connected across capacitor C5 forming a voltage divider with resistors R1 and R13 across DC power supply 18.

If the ballast is connected to an AC line voltage of less than 90 volts, capacitor C5 will not charge to a voltage sufficient to cause switch CR1 to turn on and the inverter of the ballast will be disabled. Moreover, if the ballast is on when the line voltage is reduced, and the shutdown circuit momentarily turns off the inverter but does not latch off the inverter due to insufficient holding current through the triac of IC1, the circuit could restart without resistor R16 and flash on and off. However, with resistor R16, the ballast stays off, i.e., does not restart. Resistor R16 also provides for low line voltage shutdown.

Figure 5:
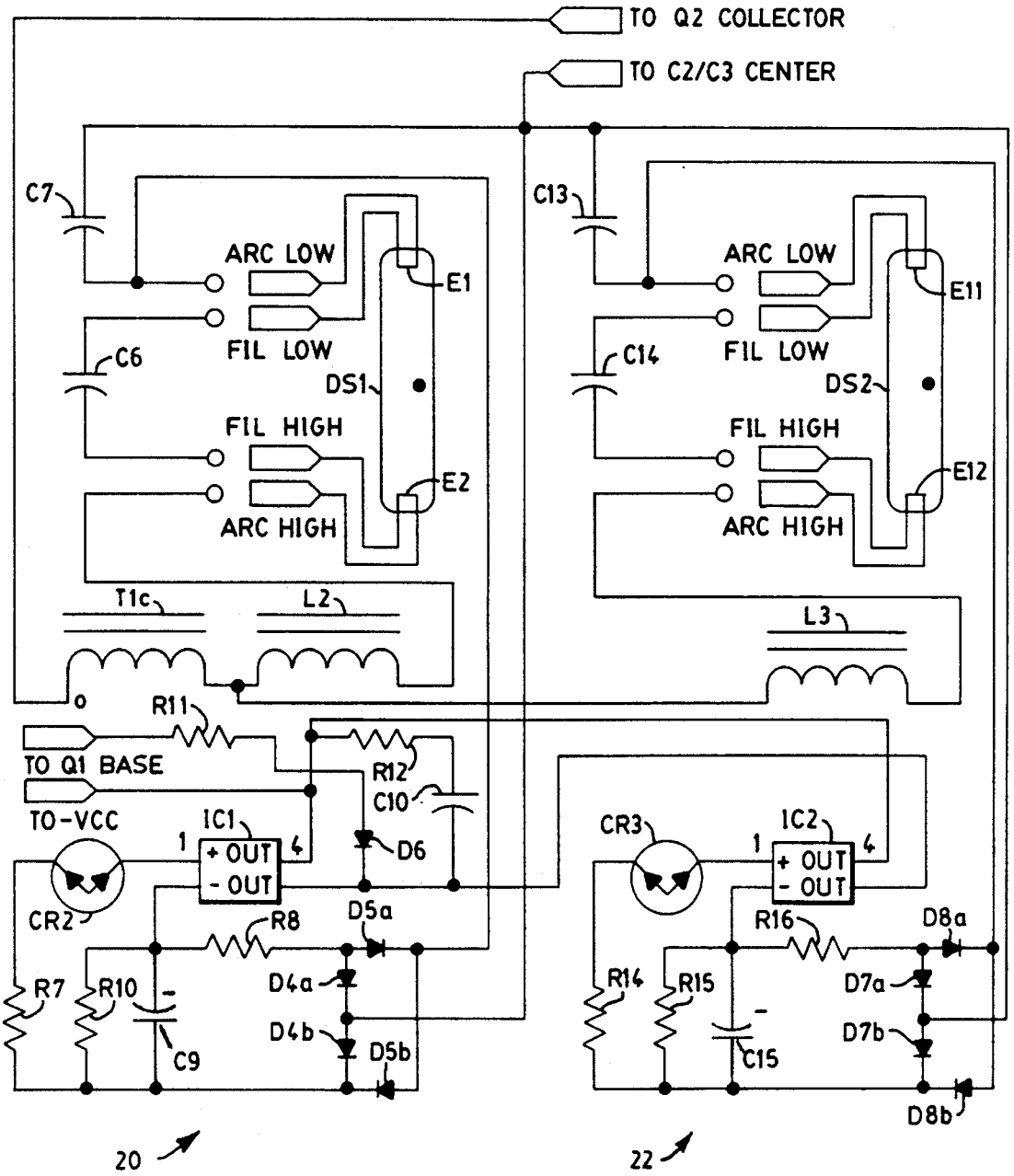
FIG. 5 is a schematic diagram of another embodiment of a ballast for multiple arc discharge lamps in accordance with the present invention.

FIG. 5 illustrates a two lamp circuit diagram demonstrating independent shutdown with multiple lamps DS1, DS2. The input side of each shutdown circuit 20 and 22 is duplicated for each lamp while the output side is common. Optical isolators IC1 and IC2 separate the input and output sides. Separate sensing capacitors C7 and C13 provide for independent lamp sensing. The shut down performs as noted above, however, failure of either lamp will shut down the ballast and extinguish both lamps. Although only two lamps are shown, it is within the scope of the invention to include any suitable number of lamps.

As a specific example but in no way to be construed as a limitation, the following components are appropriate to the embodiment of the present disclosure, as illustrated by FIGS. 4 and 5:

| Item | Type | Schematic Value |
|---|---|---|
| C1 | Capacitor (ceramic) | 0.022 MFD |
| C2 | Capacitor (electolytic) | 33 MFD |
| C3 | Capacitor (electrolytic) | 33 MFD, |
| C4 | Capacitor (ceramic) | 330 PF |
| C5 | Capacitor (ceramic) | 0.047 MFD |
| C6 | Capacitor (ceramic) | 0.0022 MFD |
| C7 | Capacitor (ceramic) | 0.022 MFD |

-continued

| Item | Type | Schematic Value |
|---|---|---|
| C9 | Capacitor (electrolytic) | 10 MFD |
| C10 | Capacitor (ceramic) | 0.022 MFD |
| C11 | Capacitor (film) | 0.5 MFD |
| C12 | Capacitor (film) | 1 MFD |
| C13 | Capacitor (ceramic) | 0.022 MFD |
| C14 | Capacitor (ceramic) | 0.0022 MFD |
| C15 | Capacitor (electrolytic) | 10 MFD |
| CB1 | Thermal Breaker | 100° C. |
| CR1 | Diac | 32 Volts |
| CR2 | Diac | 32 Volts |
| CR3 | Diac | 32 Volts |
| D1 | Diode | 1N4249 |
| D2 | Diode | 1N4249 |
| D3 | Diode | GL34J |
| D4a | Diode (½) | CMPD2004S |
| D4b | Diode (½) | CMPD2004S |
| D5a | Diode (½) | CMPD2004S |
| D5b | Diode (½) | CMPD2004S |
| D6 | Diode | 1N4937GP |
| D7 | Diode | 1N4937GP |
| D7a | Diode (½) | CMPD2004S |
| D7b | Diode (½) | CMPD2004S |
| D8 | Diode | 1N4937GP |
| D8a | Diode (½) | CMPD2004S |
| D8b | Diode (½) | CMPD2004S |
| DS1 | Fluorescent Lamp | 20 inches |
| DS2 | Fluorescent Lamp | 20 inches |
| F1 | Fuse | 3 Amps |
| IC1 | Opto/triac | TLP525G |
| IC2 | Opto/Triac | TLP525G |
| L1 | Inductor | 500 mH |
| L2 | Inductor | 4.0 mH |
| L3 | Inductor | 4.0 mH |
| Q1 | NPN Transistor | BULK26 |
| Q2 | NPN Transistor | BULK26 |
| R1 | Resistor | 220K ohm |
| R2 | Resistor | 220K ohm |
| R3 | Resistor | 33 ohm |
| R4 | Resistor | 2.7 ohm |
| R5 | Resistor | 33 ohm |
| R6 | Resistor | 2.7K ohm |
| R7 | Resistor | 330 ohm |
| R8 | Resistor | 47K ohm |
| R9 | Resistor | 220K ohm |
| R10 | Resistor | 150K ohm |
| R11 | Resistor | 330 ohm |
| R12 | Resistor | 330 ohm |
| R13 | Resistor | 220K ohm |
| R14 | Resistor (FIG. 4) | 470K ohm |
| R15 | Resistor (FIG. 4) | 470K ohm |
| R16 | Resistor (FIG. 4) | 82K ohm |
| R14 | Resistor (FIG. 5) | 330K ohm |
| R15 | Resistor (FIG. 5) | 150K ohm |
| R16 | Resistor (FIG. 5) | 47K ohm |
| R17 | Resistor | 50 ohm |
| T1a | Transformer | 3 Turns |
| T1b | Transformer | 3 Turns |
| T1c | Transformer | 5 Turns |
| VR1 | MOV | 150 VAC |

There has thus been shown and described an inverter disabling circuit which provides lamp and circuit component protection following an increase in lamp voltage resulting from a relatively small increase in cathode power. The disabling circuit does not require tight control of circuit component tolerances and is readily adaptable to multiple lamp configurations.

While there have been shown and described what are at present considered to be the preferred embodiments of the invention, it will be apparent to those skilled in the art that various changes and modifications can be made herein without departing from the scope of the invention.

What is claimed is:

1. A ballast for a discharge lamp having a pair of cathodes wherein said discharge lamp is characterized by a lamp voltage waveform having a DC voltage component when said lamp approaches end-of-life upon depletion of emissive material on one of said cathodes, said ballast comprising:

an inverter for providing an AC voltage at a pair of output terminals;

means for coupling said discharge lamp to said output terminals of said inverter;

means for monitoring a condition of each of said cathodes by measuring said DC voltage component; and means for disabling said inverter after a predetermined increase in said DC voltage component whereby excessive heating of said one of said cathodes is prevented.

2. The ballast of claim 1 wherein said predetermined increase in said DC voltage component is within the range of from about 3 to 52 volts.

3. The ballast of claim 1 wherein said inverter is disabled following an increase in power of said one of said cathodes of from about 0.3 to 6.0 watts.

4. The ballast of claim 1 wherein said means for disabling said inverter includes means for adjusting said predetermined increase in said DC voltage component.

5. The ballast of claim 1 wherein said means for disabling said inverter includes a full wave bridge rectifier having an input coupled to said means for monitoring said DC voltage component and an output coupled to a filter capacitor, said filter capacitor having an input coupled to an input of an optical isolator, an output of said optical isolator coupled to said inverter.

6. The ballast of claim 5 further including means for adjusting said predetermined increase in said DC voltage component comprising a pair of resistors connected together at a junction point, said junction point being coupled to said filter capacitor and said input of said optical isolator.

7. An arrangement comprising:

a pair of AC input terminals adapted to receive an AC signal from an AC power supply;

DC power supply means coupled to said AC input terminals for generating a DC supply voltage;

inverter means coupled to said DC power supply means to receive said DC supply voltage and including a pair of semiconductor switches, means for driving said semiconductor switches, and a pair of output terminals;

a discharge lamp coupled to said output terminals of said inverter means, said discharge lamp having a pair of cathodes and characterized by a lamp voltage waveform having a DC voltage component when said lamp approaches end-of-life upon depletion of emissive material on one of said cathodes; and means for disabling said inverter after a predetermined increase in said DC voltage component whereby excessive heating of said one of said cathodes is prevented.

8. The ballast of claim 7 wherein said predetermined increase in said DC voltage component is within the range of from about 3 to 52 volts.

9. The ballast of claim 7 wherein said inverter is disabled following an increase in power of said one of said cathodes of from about 0.3 to 6.0 watts.

10. The ballast of claim 7 wherein said means for disabling said inverter includes means for adjusting said predetermined increase in said DC voltage component.

11. The ballast of claim 7 wherein said means for disabling said inverter includes a full wave bridge rectifier having an input coupled to said means for monitoring said DC voltage component and an output coupled to a filter capacitor, said filter capacitor having an input coupled to an input of an optical isolator, an output of said optical isolator coupled to said inverter.

12. The ballast of claim 11 further including means for adjusting said predetermined increase in said DC voltage component comprising a pair of resistors connected together at a junction point, said junction point being coupled to said filter capacitor and said input of said optical isolator.

* * * * *